US008584810B2

(12) United States Patent
Tokura

(10) Patent No.: US 8,584,810 B2
(45) Date of Patent: Nov. 19, 2013

(54) BUILDING SPECIFICATION DATA FOR ELEVATOR SYSTEM, ELEVATOR CONTROL DEVICE AND DESTINATION FLOOR RECEPTION TERMINAL DEVICE

(75) Inventor: Sakurako Tokura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 295 days.

(21) Appl. No.: 12/937,380

(22) PCT Filed: Apr. 21, 2008

(86) PCT No.: PCT/JP2008/057673

§ 371 (c)(1),
(2), (4) Date: Oct. 12, 2010

(87) PCT Pub. No.: WO2009/130750

PCT Pub. Date: Oct. 29, 2009

(65) Prior Publication Data

US 2011/0036669 A1 Feb. 17, 2011

(51) Int. Cl.
*B66B 1/34* (2006.01)

(52) U.S. Cl.
USPC ..... 187/391; 187/382

(58) Field of Classification Search
USPC ..... 187/247, 380–389, 391–393, 396
See application file for complete search history.

(56) References Cited

U.S. PATENT DOCUMENTS

| | | | | |
|---|---|---|---|---|
| 6,062,346 | A * | 5/2000 | Friedli et al. | 187/395 |
| 6,202,799 | B1 * | 3/2001 | Drop | 187/388 |
| 6,349,795 | B1 * | 2/2002 | Tatsumi et al. | 187/247 |
| 6,561,319 | B2 * | 5/2003 | Mori et al. | 187/391 |
| 6,708,801 | B2 * | 3/2004 | Nakai | 187/382 |
| 6,776,264 | B2 * | 8/2004 | Tyni et al. | 187/382 |
| 6,868,945 | B2 * | 3/2005 | Schuster et al. | 187/380 |
| 6,905,003 | B2 * | 6/2005 | Hirade | 187/382 |
| 6,986,408 | B2 * | 1/2006 | Takeuchi | 187/380 |
| 7,389,857 | B2 * | 6/2008 | Hikita | 187/249 |
| 7,900,750 | B2 * | 3/2011 | Mattsson et al. | 187/247 |
| 8,151,942 | B2 * | 4/2012 | Rusanen et al. | 187/247 |

FOREIGN PATENT DOCUMENTS

| | | |
|---|---|---|
| CN | 1492831 A | 4/2004 |
| CN | 1663899 A | 9/2005 |
| JP | 2 215671 | 8/1990 |
| JP | 2000 272850 | 10/2000 |
| JP | 2001 287876 | 10/2001 |
| JP | 2005 247547 | 9/2005 |

OTHER PUBLICATIONS

International Search Report issued Jan. 20, 2009 in PCT/JP08/057673 filed Apr. 21, 2008.

(Continued)

*Primary Examiner* — Anthony Salata
(74) *Attorney, Agent, or Firm* — Oblon, Spivak, McClelland, Maier & Neustadt, L.L.P.

(57) ABSTRACT

In an elevator system, a destination call registration device converts operation key information corresponding to a pressed key into floor information by using building specification data. The destination call registration device generates a destination call registration request which includes the floor information converted from the operation key information and sends the destination call registration request to a group management control device. The group management control device registers the destination call for a destination floor indicated in the floor information. The group management control device sets building specification data and sends the building specification data to the respective destination call registration devices for conversion.

12 Claims, 9 Drawing Sheets

(56) References Cited

OTHER PUBLICATIONS

Office Action issued Aug. 17, 2012 in Chinese Patent Application No. 200880128726.6 with English language translation.
Japanese Office Action Issued Dec. 4, 2012 in Patent Application No. 2010-508982 (with partial English translation).
Office Action dated Mar. 27, 2013 issued for Chinese Application No. 200880128726.6.
English Translation of Office Action (previously submitted on May 17, 2013) dated Mar. 27, 2013 issued for Chinese Application No. 2008801287255.
Office Action dated Mar. 27, 2013 issued for Chinese Application No. 200880128726.6 (w/Partial-English Translation).
Partial-English Translation of Office Action (previously submitted on May 17, 2013) dated Mar. 27, 2013 issued for Chinese Application No. 200880128726.6 (erroneously previously identified as 2008801287255).

* cited by examiner

FIG. 4

231-1

| FLOOR INFORMATION | 1 | 2 | 3 | 4 | 5 | 6 | 7 | 8 | 9 |
|---|---|---|---|---|---|---|---|---|---|
| FLOOR NAME | B2 | B1 | 1 | 2 | 3 | 4 | 5 | 6 | 7 |

FIG. 9

231-3

| | |
|---|---|
| FLOOR DIFFERENCE | −2 |
| FLOOR ZERO EXISTS OR NOT | EXIST |

FIG. 10

| | | | |
|---|---|---|---|
| ⋮ | ⋮ | ⋮ | ⋮ |
| 3 | (3) | [+5] | <6> |
| 2 | (2) | [+4] | <5> |
| 1 | (1) | [+3] | <4> |
| 0 | (0) | [+2] | <3> |
| B1 | (-1) | [+1] | <2> |
| B2 | (-2) | [ LOWEST FLOOR ] | <1> |
| B3 | — | — | — |
| KEY | OPERATION KEY INFORMATION | DIFFERENCE FROM THE LOWEST FLOOR | FLOOR INFORMATION |
| 11 | 12 | 13 | 14 |

231-3

| | |
|---|---|
| FLOOR DIFFERENCE | −2 |
| FLOOR ZERO EXISTS OR NOT | EXIST |

FIG. 11

| ⋮ | ⋮ | ⋮ | ⋮ |
|---|---|---|---|
| 3 | (3) | [+4] | <5> |
| 4 | (2) | [+3] | <4> |
| 1 | (1) | [+2] | <3> |
| 0 | — | — | — |
| B1 | (-1) | [+1] | <2> |
| B2 | (-2) | [ LOWEST FLOOR] | <1> |
| B3 | — | — | — |
| KEY | OPERATION KEY INFORMATION | DIFFERENCE FROM THE LOWEST FLOOR | FLOOR INFORMATION |
| 11 | 12 | 13 | 14 |

231-4

| | |
|---|---|
| FLOOR DIFFERENCE | −2 |
| FLOOR ZERO EXISTS OR NOT | NOT |

BUILDING SPECIFICATION DATA FOR ELEVATOR SYSTEM, ELEVATOR CONTROL DEVICE AND DESTINATION FLOOR RECEPTION TERMINAL DEVICE

STATEMENT REGARDING FEDERALLY SPONSORED RESEARCH AND DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

TECHNICAL FIELD

The present invention relates to an elevator system to perform a destination floor registration before boarding.

BACKGROUND ART

Conventional elevator systems to perform a destination floor registration before boarding propose:

(1) A destination call registration device wherein an "assigned car display panel" is placed adjacent to a destination floor button installed in a lobby, an assigned car is displayed on the "assigned car display panel" adjacent to the destination floor button which is operated when the assigned car is determined, and the display is continued until the assigned car reaches a floor wherein the operated destination floor button is installed, in Japanese Unexamined Patent Publication No. 2000-272850, for example; and (2) Furthermore, a destination floor registration device including a numerical keypad and a conversion table to convert key information into floor information and a floor name to be used for a call registration, in Japanese Unexamined Patent Publication No. 2005-247547.

Patent literature 1: Japanese Unexamined Patent Publication No. 2000-272850

Patent literature 2: Japanese Unexamined Patent Publication No. 2005-247547

DISCLOSURE OF THE INVENTION

Problems to be Solved by the Invention

In the conventional elevator systems, for example, since the elevator system described in Japanese Unexamined Patent Publication No. 2000-272850 includes a destination floor button as a destination call registration device, the destination call registration devices in the number of kinds of floors are necessary when a great number of floors are equipped with the destination call registration devices. Further, the elevator system described in Japanese Unexamined Patent Publication No. 2005-247547 proposes the destination floor registration device including the numerical keypad and the conversion table, and such a destination floor registration device requires setting of the conversion table for each destination floor registration device, which results in troublesome setting when the destination floor registration devices are great in number.

Means to Solve the Problems

There is provided according to one aspect of the present invention an elevator system includes: a plurality of destination floor reception terminal devices to output, when an operation key corresponding to a floor of a destination floor of an elevator is operated, operation key information corresponding to the operation key, to convert the operation key information which is output into floor information which is used for a registration of a destination call by using information for conversion as prescribed, to generate and send a destination call registration request which includes the floor information whereto the operation key information is converted, and which requests the registration of the destination call; and an elevator control device to receive the destination call registration request from each of the plurality of destination floor reception terminal devices via a communication channel, and to register the destination call in accordance with the floor information which is included in the destination call registration request, wherein the elevator control device includes a control side storing unit to store the information for conversion, and a control side communication unit to send the information for conversion which is stored in the control side storing unit to the plurality of destination floor reception terminal devices via the communication channel, and wherein each of the plurality of destination floor reception terminal devices includes a terminal side communication unit to receive the information for conversion from the elevator control device via the communication channel, a terminal side storing unit to store the information for conversion which is received by the terminal side communication unit, a terminal side operation key information output unit to output the operation key information when the operation key is operated, and a terminal side data conversion unit to convert the operation key information which is output by the terminal side operation key information output unit into the floor information in accordance with a prescribed conversion rule by using the information for conversion which is stored in the terminal side storing unit, to generate the destination call registration request which includes the floor information whereto the operation key information is converted, and to send the destination call registration request which is generated to the elevator control device via the terminal side communication unit.

The control side communication unit sends a correspondence table which indicates a correspondence of the floor information and the operation key information to each floor which is a floor of a building wherein the elevator is installed, and whereon a car of the elevator can stop, as the information for conversion.

The information for conversion which is stored in the control side storing unit includes at least lowest level designation information to designate the operation key information corresponding to a lowest level floor as a floor to be at a lowest level.

The information for conversion which is stored in the control side storing unit further includes designation information of specific floor application to designate application of a specific floor.

The designation information of specific floor application designates application of a floor zero which is a floor between a first basement floor and a first floor.

The terminal side data conversion unit specifies the operation key information corresponding to the lowest level floor by using the lowest level designation information which is stored in the terminal side storing unit, determines a floor difference between the lowest level floor and each of the floor based on the operation key information corresponding to the lowest level floor and each of the operation key information corresponding to each of the floor, and converts the operation key information which is output by the terminal side operation key information output unit into the floor information based on the floor difference which is determined.

There is provided according to one aspect of the present invention an elevator control device to receive, from a plurality of destination floor reception terminal device which convert, when an operation key corresponding to a destination floor of an elevator is operated, operation key information corresponding to the operation key into floor information which is used for a registration of a destination call by using information for conversion as prescribed, and which generate and send a destination call registration request which includes the floor information whereto the operation key information is converted and which requests the registration of the destination call, the destination call registration request via a communication channel, and to register the destination call in accordance with the floor information which is included in the destination call registration request, the elevator control device includes: a control side storing unit to store the information for conversion; and a control side communication unit to send the information for conversion to each of the plurality of destination floor reception terminal devices via the communication channel.

There is provided according to one aspect of the present invention a destination floor reception terminal device of an elevator to receive a registration of a destination floor of the elevator, the destination floor reception terminal device of the elevator includes: a terminal side operation key information output unit to output, when an operation key corresponding to the destination floor is operated, operation key information corresponding to the operation key; a terminal side communication unit to receive, from an elevator control device to register a destination call for the elevator in response to a request, and to send information for conversion to convert the operation key information into floor information which is used for a destination call registration, the information for conversion; a terminal side storing unit to store the information for conversion which is received by the terminal side communication unit; and a terminal side data conversion unit to convert the operation key information which is output by the terminal side operation key information output unit into the floor information in accordance with a prescribed conversion rule by using the information for conversion which is stored in the terminal side storing unit, to generate a destination call registration request which includes the floor information whereto the operation key information is converted and which requests the destination call registration, and to send the destination call registration request which is generated to the elevator control device via the terminal side communication unit.

Effect of the Invention

The elevator system in the present invention facilitates setting of building specification data for a destination call registration device including a numerical keypad.

BRIEF DESCRIPTION OF THE DRAWINGS

[FIG. 4] The data configuration diagram of the building specification data 231 according to the first embodiment.

[FIG. 9] The building specification data (231-3) according to the second embodiment.

[FIG. 10] The diagram describing the process to generate the floor information by using the building specification data (231-3) in FIG. 9.

[FIG. 11] The diagram describing the process to generate the floor information by using the building specification data (231-4).

PREFERRED EMBODIMENTS FOR CARRYING OUT THE INVENTION

Embodiment 1

Figure 1:
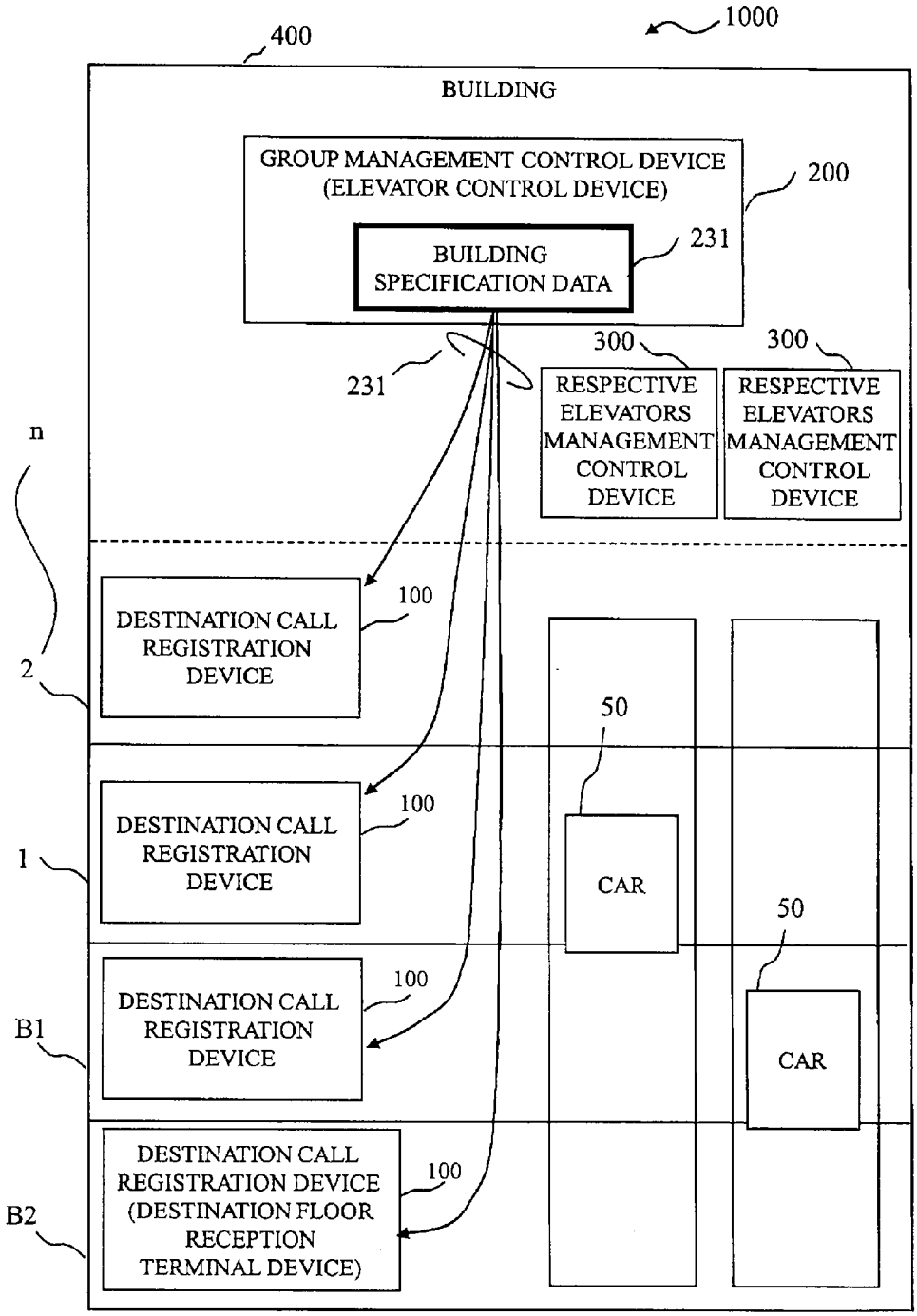
[FIG. 1] The system configuration diagram illustrating the overview of the elevator system 1000 according to the first embodiment.

FIG. 1 is a system configuration diagram illustrating an overview of an elevator system 1000 in the first embodiment. The overview of the elevator system 1000 will be explained with reference to FIG. 1. The elevator system 1000 is installed in a building 400. The elevator system 1000 includes one group management control device 200 (elevator control device), a plurality of respective elevators management control devices 300 to manage each elevator and control motions of a "car 50" in each elevator, and a plurality of destination call registration devices 100 (destination floor reception terminal devices) installed in elevator lobbies from the second basement floor (B2) to floor n (nth floor) of the building 400.

(Overview of Operations)

In the elevator system 1000, for example, an elevator user presses a key "1" of the numerical keypad in the destination call registration device 100 on the second basement floor to go to the first floor on the second basement level. In this case, the destination call registration device 100 outputs key information (operation key information) corresponding to the key "1," and converts the output key information into "floor information" by using "building specification data" (one example of information for conversion) as will be discussed below. The "floor information," as will be explained below, is information to be used for registration of a "destination call" by the group management control device 200. That is, the group management control device 200 regards a floor indicated in the floor information as a destination floor. The destination call registration device 100 generates and transmits to the group management control device 200 a "destination call registration request" including the floor information which is converted into from the key information and requesting registration of the "destination call."

The features of the elevator system 1000 described in FIG. 1 are the group management control device 200 stores beforehand building specification data 231 to convert key information into floor information, and the group management control device 200 delivers the building specification data 231 to each destination call registration device 100 via a communication channel. Each destination call registration device 100 stores the delivered building specification data 231, and uses the building specification data 231 when converting key information into floor information.

(Hardware Configuration)

Figure 2:
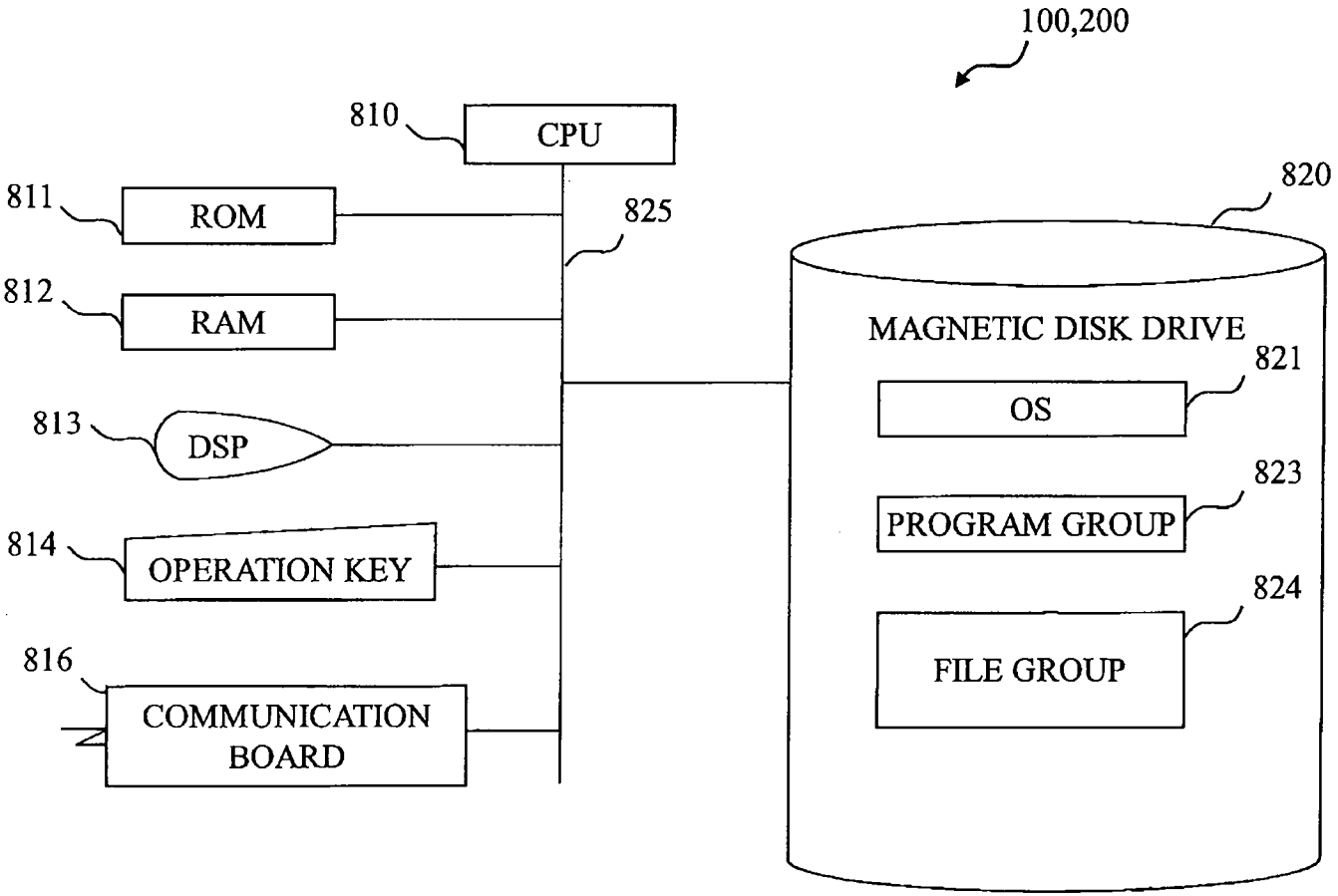
[FIG. 2] The diagram describing one example of hardware resources of the destination call registration device 100 and the group management control device 200 according to the first embodiment.

FIG. 2 is a diagram describing one example of hardware resources of the destination call registration device 100 and the group management control device 200 in the elevator system 1000 according to the first embodiment. Both the destination call registration device 100 and the group management control device 200 are computers including the hardware resources as shown in FIG. 2. Although the explanation below is provided of the group management control device 200 in FIG. 2, the explanation of the group management control device 200 similarly applies to the destination call registration device 100. The group management control device 200 and each of the respective elevators management control devices 300 are described as separate devices in FIG. 1, which is illustrative only. The group management control device 200 and each of the respective elevators management control devices 300 may be realized as separate devices as in FIG. 1, or the group management control device 200 and each of the respective elevators management control devices 300 may be realized by one device by having functions of each of the respective elevators management control devices 300 included in the group management control device 200. Further, the group management control device 200 may be configured as not having a display unit 813 and an operation key 814.

In FIG. 2, the group management control device 200 includes a CPU (Central Processing Unit) 810 to execute programs. The CPU 810 is connected to a ROM (Read Only Memory) 811, a RAM (Random Access Memory) 812, the display unit 813, the operation key 814, a communication board 816 and a magnetic disk drive 820 via a bus 825, and controls these hardware devices. A memory device such as a flash memory can be used instead of the magnetic disk drive 820.

The RAM 812 is one example of volatile memories. Storage media such as the ROM 811 and the magnetic disk drive 820, etc. are examples of non-volatile memories. These are examples of memory devices, memory units or storage units. The communication board 816, the operation key 814, etc. are examples of input units or input devices. Further, the communication board 816, the display unit 813, etc. are examples of output units or output devices.

The communication board 816 is connected to a network. The destination call registration devices 100, the group management control device 200, and the respective elevators management control devices 300 are connected by the network, and are able to perform information communication with one another.

The magnetic disk drive 820 stores an operating system (OS) 821, a program group 823 and a file group 824. Programs in the program group 823 are executed by the CPU 810 and the operating system 821.

The program group 823 stores programs which perform functions described as " . . . unit" in the following explanations of the embodiments. The programs are read out and executed by the CPU 810.

The file group 824 stores information described as "building specification data," information described as "determination result of . . . ," "calculation result of . . . ," "extraction result of . . . ," "generation result of . . . ," and "processing result of . . . ," data, signal values, variable values or parameters, etc. in the following explanations of the embodiments as each item in " . . . file" or " . . . database". " . . . file" and " . . . database" are stored in a recording medium such as a disk or a memory, etc. The information, data, signal values, variable values and parameters stored in a memory medium such as a disk or a memory, etc. are read out to a main memory or a cache memory by the CPU 810 via a read/write circuit, and used for operations of the CPU such as extraction, search, reference, comparison, operation, calculation, processing, output, display, etc. During the operations of the CPU, such as extraction, search, reference, comparison, operation, calculation, processing, output and display, the information, data, signal values, variable values and parameters are temporarily stored in the main memory, the cache memory, or a buffer memory.

Further, what is described as " . . . unit" in the following explanations of the embodiments may be " . . . means," " . . . device," " . . . circuit," or " . . . equipment," or further may be " . . . step," " . . . procedure," or " . . . processing". That is, what is described as " . . . unit" may be realized by firmware stored in the ROM 811. Otherwise, it may be executed by software only, hardware only such as an element, a device, a substrate, a wire, etc., a combination of software and hardware or a combination further with firmware. The programs are read out by the CPU 810 and executed by the CPU 810. That is, the programs make a computer function as " . . . unit" described below.

Figure 3:
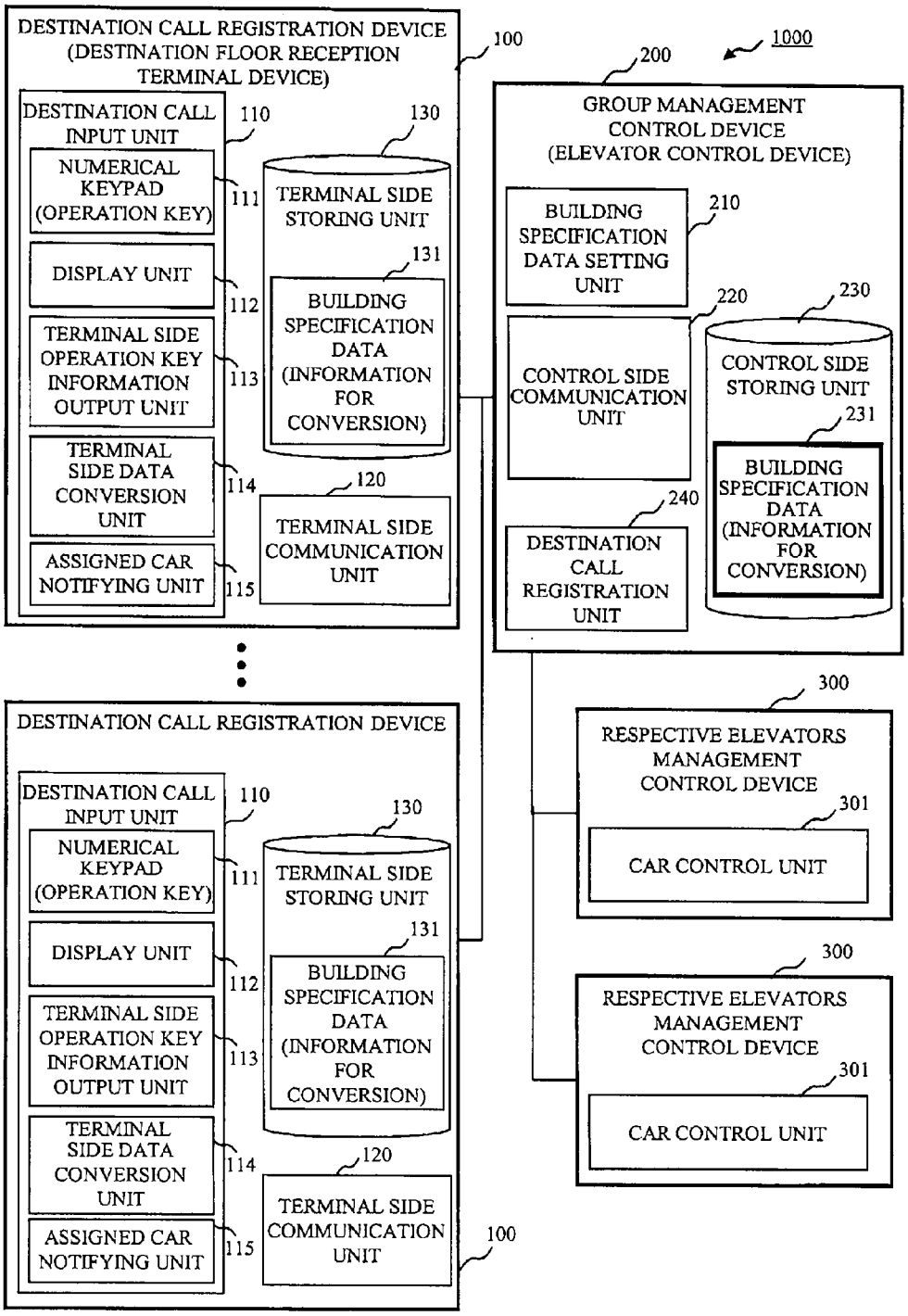
[FIG. 3] The block diagram of the elevator system according to the first embodiment.

FIG. 3 is a block diagram of the elevator system 1000.

(Destination Call Registration Device 100)

The destination call registration device 100 registers a destination floor of an elevator. The destination call registration device 100 is equipped with a destination call input unit 110, a terminal side storing unit 130 to store building specification data 131, a terminal side communication unit 120 having a communication function with the group management control device 200. Further, the destination call input unit 110 is equipped with a numerical keypad 111 (operation key) to input a destination floor, a display unit 112 to display an assigned car, a terminal side operation key information output unit 113 to output key information (operation key information) corresponding to a key when a destination floor is input from the numerical keypad 111, i.e., the key corresponding to the destination floor is manipulated, a terminal side data conversion unit 114 to convert the key information into floor information using the building specification data delivered from the group management control device 200, and an assigned car notifying unit 115 to display an assigned car on the display unit 112.

(Group Management Control Device 200)

The group management control device 200 manages and controls the plural cars 50 via the respective elevators management control devices 300. The group management control device 200 is equipped with a building specification data setting unit 210 to receive a setting of the building specification data 231 and store the building specification data 231 in a control side storing unit 230, a control side communication unit 220 to send the building specification data 231 to each of the destination call registration devices 100, the control side storing unit 230 to store the building specification data 231, and a destination call registration unit 240 to register a destination call in response to a destination call registration request and assign a "car 50" to respond.

(Respective Elevators Management Control Device 300)

The respective elevators management control device 300 is equipped with a car control unit 301 to manage and control a pertinent "car 50".

(Floor Information)

FIG. 4 is a data configuration diagram of building specification data (231-1) (correspondence table) which is delivered to each of the destination call registration devices 100 by the group management control device 200. FIG. 4 is one example of "building specification data," and the building specification data (231-1) in FIG. 4 is in a form of a table with rows of floor information to be converted and a floor name (may be operation key information corresponding to the floor name). In this case, the floor information is information to be used when the group management control device 200 registers a destination call wherein the bottom limit of a bank managed by the group management control device 200 is numbered 1. The floor information is explained with reference to FIG. 7. Furthermore, the floor name is designation of each floor recognized by elevator users which is different from the floor information, and is uniquely determined for each floor with respect to each bank. The building specification data (231-1) in FIG. 4 is a table showing correspondence between the floor information and the floor name (indicates the operation key information) for each floor of a building where an elevator is installed and on which an elevator car can stop.

(Operation)

Figure 5:
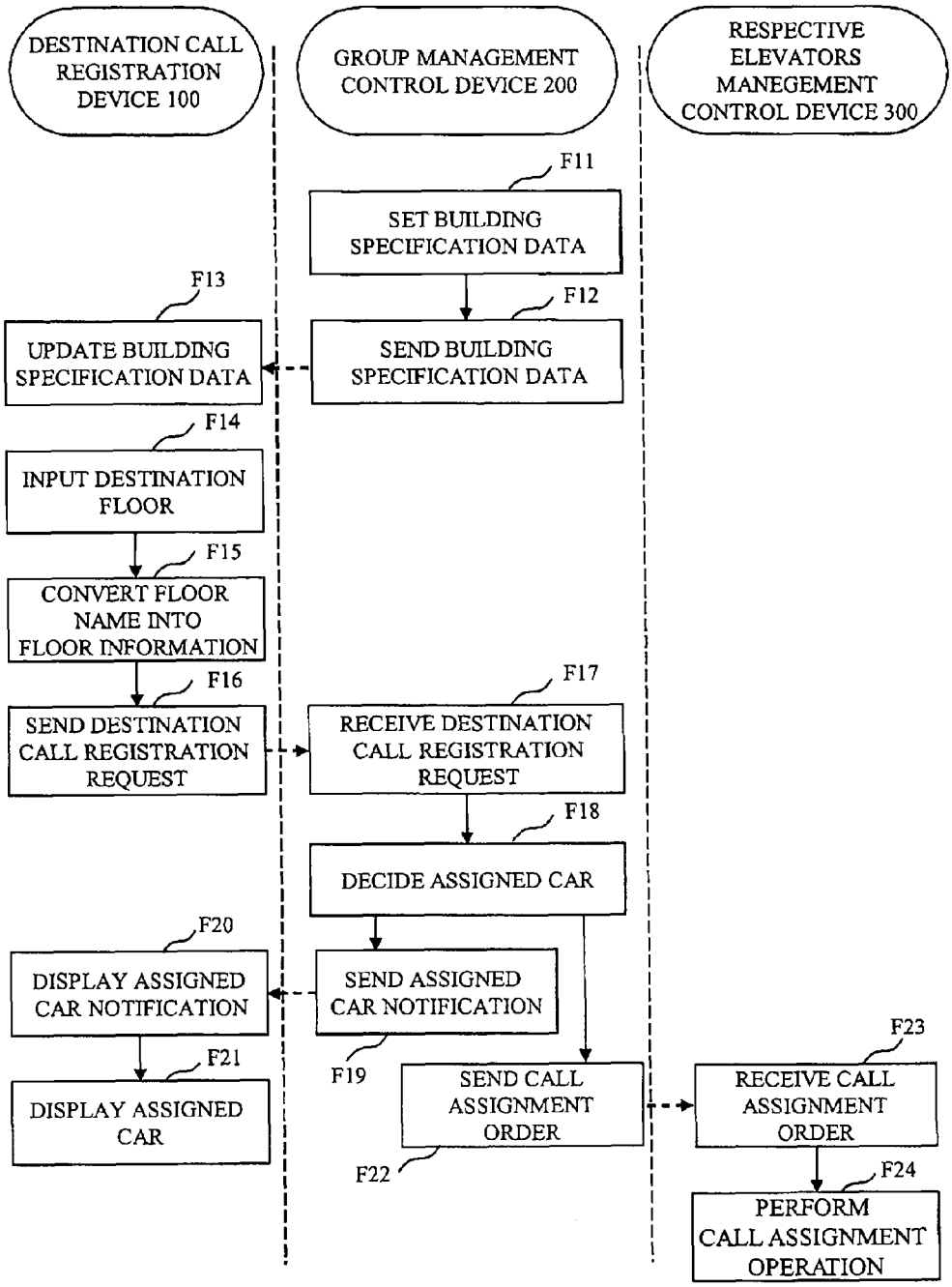
[FIG. 5] according to the first embodiment is the flow chart illustrating the operations in the elevator system 1000.

FIG. 5 is a flow chart illustrating operations in the elevator system 1000. An explanation is provided below of the operations in the elevator system 1000 with reference to FIG. 5.

(Group Management Control Device 200)

The building specification data setting unit 210 sets the building specification data 231, and stores the building specification data 231 in the control side storing unit 230 (F11). The control side communication unit 220 sends the building specification data 231 to each of the destination call registration devices 100 (F12).

(Destination Call Registration Device 100)

In each of the destination call registration devices 100, the terminal side communication unit 120 receives the building specification data 231 sent from the group management control device 200, and stores the building specification data 231 as the building specification data 131 in the terminal side storing unit 130. In this way, the building specification data 131 of the terminal side storing unit 130 is updated (F13). Otherwise, when the building specification data 131 is not stored in the terminal side storing unit 130 yet, the building specification data 131 is stored here. The building specification data 231 may be sent by the group management control device 200 every time when the building specification data 231 is set in the group management control device 200, or may be sent from the group management control device 200 periodically at regular time intervals. The building specification data 231 may be sent from the group management control device 200 at any timing.

In the destination call registration devices 100, when a floor name of a destination floor is input by manipulation of the numerical keypad 111 in the destination call input unit 110 (F14), i.e., when keys on the numerical keypad 111 corresponding to the destination floor are manipulated, the destination call input unit 110 needs to send a destination call registration request to request registration of a destination call to the group management control device 200 via the terminal side communication unit 120. However, when the numerical keypad 111 is applied to the destination call registration device 100, the floors which can be input by combination on the numerical keypad 111 become huge in number. Therefore, if data input from the numerical keypad 111, i.e., key information corresponding to the manipulated keys is sent to the group management control device 200 without being changed, data transmission specification becomes complicated, and false key inputs are also sent to the group management control device 200. In this case, unnecessary data transmission and reception occurs.

Therefore, the terminal side data conversion unit 114 in the destination call input unit 110 converts a floor name (operation key information) into floor information using the building specification data 131 (information for conversion) (F15), and sends a destination call registration request to the group management control device 200 (F16). That is, in the destination call registration device 100, when keys on the numerical keypad 111 are manipulated, the terminal side operation key information output unit 113 outputs the operation key information corresponding to the manipulated keys. When the terminal side operation key information output unit 113 outputs the operation key information, the terminal side data conversion unit 114 converts the operation key information into the floor information in accordance with a "prescribed conversion rule" by using the building specification data 131 sent from the group management control device 200 and stored in the terminal side storing unit 130. Then, the terminal side data conversion unit 114 generates the destination call registration request including the floor information whereto the operation key information is converted, and sends the generated destination call registration request to the group management control device 200 via the terminal side communication unit 120. In the case of FIG. 4, the terminal side data conversion unit 114 converts operation key information into floor information corresponding to a floor name indicated in the operation key information as the "prescribed conversion rule". For example, when operation key information indicates a floor name "3," the operation key information is converted into floor information "5". In this case, specifically, when "3" on the numerical keypad is pressed, the terminal side operation key information output unit 113 outputs a "signal indicating (3)" as operation key information. When the operation key information (3) is output, the terminal side data conversion unit 114 converts the operation key information (3) into floor information <5> in accordance with the building specification data of FIG. 4. When "input of a floor name" (key input on the numerical keypad 111) which cannot be converted into floor information by using the building specification data 131, such as a nonexistent floor, is performed, the terminal side data conversion unit 114 displays an error display on the display unit 112 without sending a destination call registration request.

(Group Management Control Device 200)

When the group management control device 200 receives the destination call registration request from the destination call registration device 100 by the control side communication unit 220 (F17), the group management control device 200 responds to the destination call registration request, and the destination call registration unit 240 registers a destination call, and determines an assigned car in response to the destination call (F18). Then, the control side communication unit 220 sends an "assigned car notification" to notify the assigned car which is determined to the destination call registration device 100 (F19).

(Destination Call Registration Device 100)

When the terminal side communication unit 120 receives the "assigned car notification" from the group management control device 200 (F20), the assigned car notifying unit 115 displays the assigned car on the display unit 12 (F21).

(Group Management Control Device 200)

Further, the destination call registration unit 240 in the group management control device 200 sends a call assignment order to the car control unit 301 in the respective elevators management control device 300 which controls the assigned car via the control side communication unit 220 (F22).

(Respective Elevators Management Control Device 300)

When the car control unit 301 in the pertinent respective elevators management control device 300 receives the call assignment order from the group management control device 200 (F23), the car control unit 301 performs a call assignment operation (F24).

According to the first embodiment as described above, in the elevator system which performs a destination call registration by the destination call registration device including the numerical keypad, since the building specification data of the destination call registration devices is collectively managed and sent by the group management control device, it becomes easier to set the building specification data for each destination call registration terminal.

Embodiment 2

Figure 6:
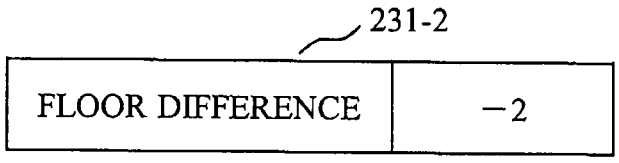
[FIG. 6] The building specification data (231-2) according to the second embodiment.
Figure 7:
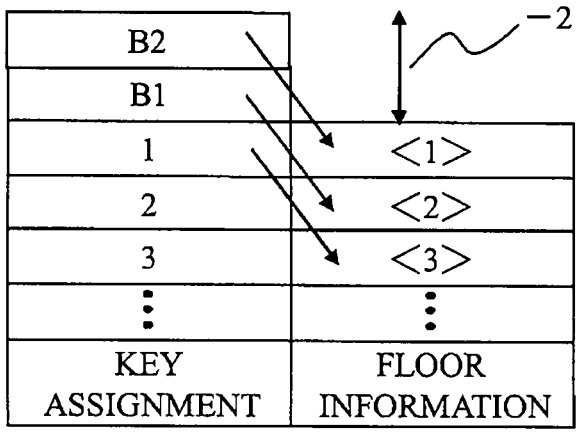
[FIG. 7] The diagram describing the values of the floor differences according to the second embodiment.

In the first embodiment, the building specification data 231 sent from the group management control device 200 is in a form of a table with rows of a floor name and floor information as shown in FIG. 4. However, the composition of buildings wherein elevators are installed is generally such that floors are numbered in order from the basement floor, and in many cases, floor names are, for example, B2, B1, $1^{st}$, $2^{nd}$, $3^{rd}$ and so on. Therefore, data can be simplified as the data formation of the building specification data (231-2) as shown in FIG. 6. The data formation of FIG. 6 is made up only of a value of floor difference between the floors indicated in the "floor information" and the "floor name" (one example of lowest level designation information). With this value of floor difference between the floors indicated in the "floor information" and the "floor name," the terminal side data conversion unit 114 in the destination call registration device 100 can specify operation key information corresponding to the lowest level floor as a floor to be at the lowest level. FIG. 7 is a diagram describing the value of the floor difference (lowest level designation information). The floor information used by the group management control device 200 is generally consecutive integral numbers beginning from <1>. The floor information generally corresponds consecutively from <1>, from the lower level to the higher level. For example, the floor information <1> corresponds to the second basement floor "B2," and the floor information <2> corresponds to the first basement floor "B1" as shown in FIG. 7. The floor difference "−2" means that the B2 floor is designated as the lowest level floor. The data formation as shown in FIG. 6 allows for laborsaving in setting of the building specification data, and reduction of transmission data sent from the group management control device 200 to the destination call registration devices 100.

Figure 8:
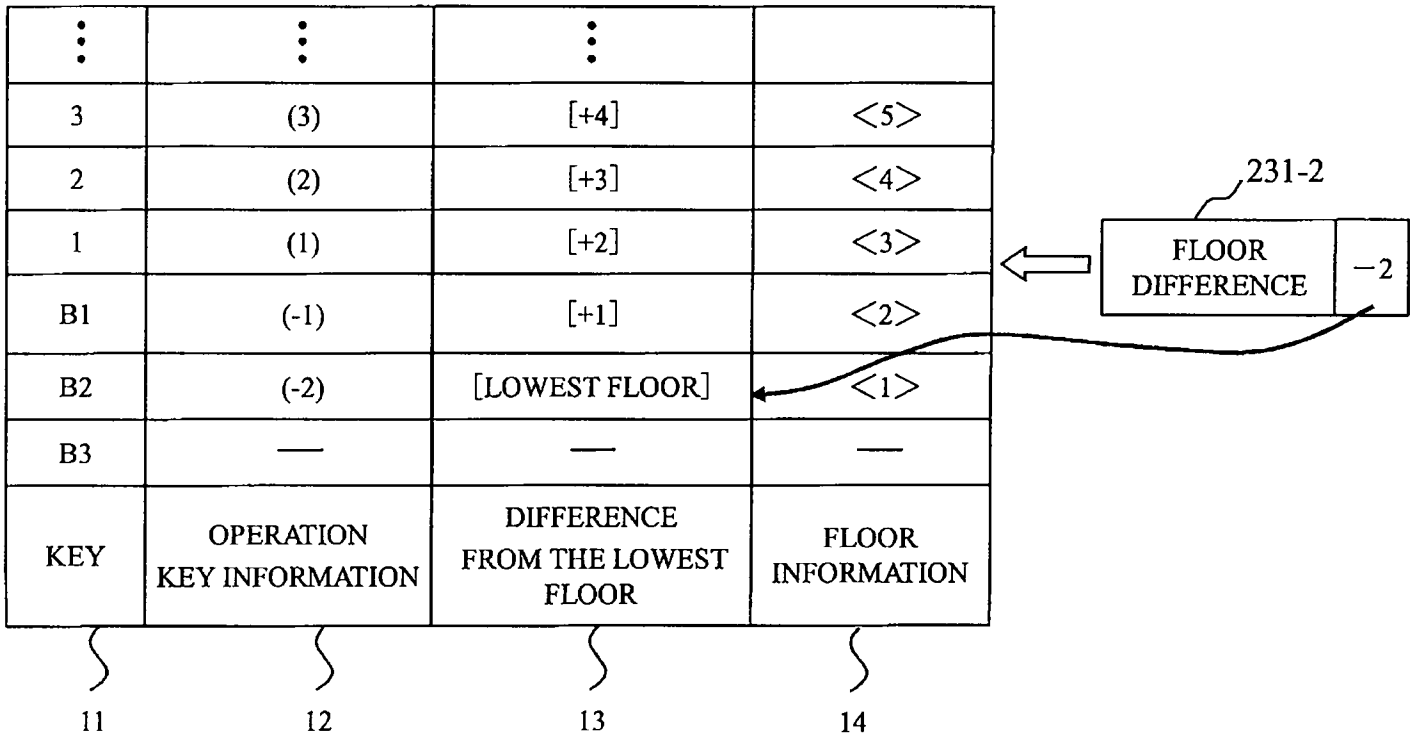
[FIG. 8] The diagram describing the process to generate the floor information by using the building specification data (231-2) in FIG. 6.

FIG. 8 is a diagram describing a case in which the destination call registration device 100 generates the floor information by using the building specification data (231-2) in FIG. 6.

(1) The column 11 indicates a key input (floor name) input from the numerical keypad 111.
(2) The column 12 indicates "operation key information" corresponding to the pressed key.

For example, when "B1" is pressed, operation key information (−1) is output by the terminal side operation key information output unit 113.

(3) The column 13 indicates "difference from the lowest floor" recognized by the terminal side data conversion unit 114.
(4) The column 14 indicates floor information corresponding to the operation key information.

When the building specification data (231-2) is delivered, floor information is generated as follows by the destination call registration device 100. Since the building specification data (231-2) indicates that the floor difference is "−2" (lowest level designation information), the terminal side data conversion unit 114 determines the operation key information (−2) as the lowest level floor. Therefore, the terminal side data conversion unit 114 converts the operation key information (−2) into the floor information <1>. Meanwhile, the terminal side data conversion unit 114 can determine difference between each floor (operation key information) and the lowest level floor. For example, when a key "B1" is pressed, operation key information (−1) is output. The terminal side data conversion unit 114 can determine that the operation key information (−1) is [+1] with respect to the lowest level floor. Thus, the terminal side data conversion unit 114 converts the operation key information (−1) into the floor information <2>. It is also the same when the other keys are pressed.

When the terminal side data conversion unit 114 receives the building specification data (231-2), the terminal side data conversion unit 114 can hold the data in FIG. 8 in a form of the building specification data (231-1) shown in FIG. 4 by relating the correspondence between the column 12 and the column 14.

(Response to Floor Zero)

Furthermore, depending on the composition of buildings, floor zero exists between the first basement floor and the first floor. For this reason, as a data formation shown in FIG. 9, building specification data (231-3) may be composed of "floor difference" and "floor zero exists or not" (one example of designation information of specific floor application).

FIG. 10 is a diagram describing a case in which the destination call registration device 100 generates floor information by using the building specification data (231-3) in FIG. 9. When the building specification data (231-3) is delivered, the floor information is generated as follows by the destination call registration device 100. Since the building specification data (231-3) indicates that the floor difference is "−2", the terminal side data conversion unit 114 determines operation key information (−2) as the lowest level floor. Thus, the terminal side data conversion unit 114 converts the operation key information "−2" into the floor information <1>. This is the same as in the case of FIG. 8. Further, since "exist" is indicated in the field of "floor zero exists or not" in the building specification data (231-3), the terminal side data conversion unit 114 takes floor zero into consideration when determining differences between each floor (operation key information) and the lowest level floor. That is, the terminal side data conversion unit 114 determines values in the column 13 as the differences from the lowest level floor by including operation key information (0) as well as an object, as shown in the column 13 of FIG. 10. That is, for example, operation key information (2) is output when the operation key "2" is pressed, in which case the terminal side data conversion unit 114 determines that the operation key information (2) has a floor difference [+4] with respect to the lowest level floor (operation key information (−2)). Therefore, the terminal side data conversion unit 114 converts the operation key information (2) into floor information <5>. It is also the same when the other operation keys are pressed.

FIG. 11 is a diagram describing a case in which the destination call registration device 100 generates floor information by using building specification data (231-4). The building specification data (231-4) is information whereof the field of "floor zero exists or not" is "not". When the building specification data (231-4) is delivered, the floor information is generated as follows by the destination call registration device 100. Since the building specification data (231-4) indicates that a floor difference is "−2," the terminal side data conversion unit 114 determines operation key information (−2) as the lowest level floor. Therefore, the terminal side data conversion unit 114 converts the operation key information (−2) into floor information <1>. Meanwhile, the field of "floor zero exists or not" in the building specification data (231-4) is "not", the terminal side data conversion unit 114 does not take floor zero into consideration when determining differences between each floor (operation key information) and the lowest level floor. That is, the terminal side data conversion unit 114 determines values in the column 13 as differences from the lowest level floor without including the operation key information (0) as an object, as shown in the column 13 of FIG. 11. For example, the operation key information (2) is output when the operation key "2" is pressed, in which case the terminal side data conversion unit 114 determines that the operation key information (2) has a floor difference [+3] with respect to the lowest level floor. Thus, the terminal side data conversion unit 114 converts the operation key information (2) into floor information <4>. It is also the same when the other operation keys are pressed.

In addition, in the case of the building specification data (231-3) shown in FIG. 10 or the building specification data (231-4) shown in FIG. 11 as in the case of FIG. 8, when the terminal side data conversion unit 114 receives the building specification data (231-3) or the building specification data (231-4), the terminal side data conversion unit 114 may hold the building specification data (231-3) or the building specification data (231-4) in the form of the building specification data (231-1) shown in FIG. 4 by relating the correspondence between the column 12 and the column 14.

It is explained in the above-mentioned embodiments an elevator system wherein the group management control device to register a destination call by the destination call registration device including the numerical keypad includes the function to manage collectively building specification data which is necessary for a destination call registration, and to send the building specification data to each destination call registration device.

It is explained in the above-mentioned embodiments the group management control device 200 to send only a difference between floor information and a floor name of an elevator as the building specification data.

It is explained in the above-mentioned embodiments the group management control device 200 to send a difference between floor information and a floor name of an elevator, and existence or nonexistence of a floor between the first basement floor and the first floor, as the building specification data.

The elevator system 1000 described above can be used in an elevator system to perform a destination call registration by a destination call registration device including a numerical keypad.

Description of the Reference Numerals

50 Car, 100 Destination call registration device, 110 Destination call input unit, 111 Numerical keypad, 112 Display unit, 113 Terminal side operation key information output unit, 114 Terminal side data conversion unit, 115 Assigned car notifying unit, 120 Terminal side communication unit, 130 Terminal side storing unit, 131 Building specification data, 200 Group management control device, 210 Building specification data setting unit, 220 Control side communication unit, 230 Control side storing unit, 231, 231-1, 231-2, 231-3 Building specification data, 240 Destination call registration unit, 300 Respective elevators management control device, 301 Car control unit, 400 Building, 1000 Elevator system.

The invention claimed is:

1. An elevator system comprising:

a plurality of destination floor reception terminal devices to output, when an operation key corresponding to a floor of a destination floor of an elevator is operated, operation key information corresponding to the operation key, to convert the operation key information which is output into floor information which is used for a registration of a destination call by using information for conversion as prescribed, and to generate and send a destination call registration request which includes the floor information whereto the operation key information is converted, and which requests the registration of the destination call; and an elevator control device to receive the destination call registration request from each of the plurality of destination floor reception terminal devices via a communication channel, and to register the destination call in accordance with the floor information which is included in the destination call registration request, wherein the elevator control device includes a control side storing unit to store information for conversion which includes lowest level designation information to designate the operation key information corresponding to a lowest level floor to be at a lowest level as the information for conversion as prescribed, and a control side communication unit to send the information for conversion which is stored in the control side storing unit to the plurality of destination floor reception terminal devices via the communication channel, and wherein each of the plurality of destination floor reception terminal devices includes a terminal side communication unit to receive the information for conversion from the elevator control device via the communication channel, a terminal side storing unit to store the information for conversion which is received by the terminal side communication unit, a terminal side operation key information output unit to output the operation key information when the operation key is operated, and a terminal side data conversion unit to convert the operation key information that is the operation key information corresponding to the lowest level floor and the operation key information corresponding to a floor other than the lowest level floor, which is output by the terminal side operation key information output unit into the floor information in accordance with a prescribed conversion rule by using the lowest level designation information included in the information for conversion which is stored in the terminal side storing unit, to generate the destination call registration request which includes the floor information whereto the operation key information is converted, and to send the destination call registration request which is generated to the elevator control device via the terminal side communication unit.

2. The elevator system as defined in claim 1, wherein the information for conversion which is stored in the control side storing unit further includes designation information of specific floor application to designate application of a specific floor, and the terminal side data conversion unit converts the operation key information that is the operation key information corresponding to the lowest level floor and the operation key information corresponding to the floor other than the lowest level floor, which is output by the terminal side operation key information output unit, into the floor information by using the lowest level designation information included in the information for conversion which is stored in the terminal side storing unit, and the designation information of the specific floor application.

3. The elevator system as defined in claim 2, wherein the designation information of the specific floor application designates application of a floor zero which is a floor between a first basement floor and a first floor.

4. The elevator system as defined in claim 1, wherein the terminal side data conversion unit specifies the operation key information corresponding to the lowest level floor by using the lowest level designation information which is stored in the terminal side storing unit, determines a floor difference between the lowest level floor and each of the floor based on the operation key information corresponding to the lowest level floor and each of the operation key information corresponding to each of the floor, and converts the operation key information which is output by the terminal side operation key information output unit into the floor information based on the floor difference which is determined.

5. An elevator control device to receive, from a plurality of destination floor reception terminal device which convert, when an operation key corresponding to a destination floor of an elevator is operated, operation key information corresponding to the operation key into floor information which is used for a registration of a destination call by using information for conversion as prescribed, and which generate and send a destination call registration request which includes the floor information whereto the operation key information is converted and which requests the registration of the destination call, the destination call registration request via a communication channel, and to register the destination call in accordance with the floor information which is included in the destination call registration request, the elevator control device comprising:

a control side storing unit to store information for conversion which consists only of lowest level designation information to designate the operation key information corresponding to a lowest level floor as a floor to be at a lowest level as the information for conversion as prescribed; and a control side communication unit to send the information for conversion consisting only of the lowest level designation information which is stored in the control side storing unit to each of the plurality of destination floor reception terminal devices via the communication channel.

6. A destination floor reception terminal device of an elevator to receive a registration of a destination floor of the elevator, the destination floor reception terminal device of the elevator comprising:

a terminal side operation key information output unit to output, when an operation key corresponding to the destination floor is operated, operation key information corresponding to the operation key;

a terminal side communication unit to receive, from an elevator control device to register a destination call for the elevator in response to a request, and to send information for conversion to convert the operation key information into floor information which is used for a destination call registration, the information for conversion including lowest level designation information to designate the operation key information corresponding to a lowest level floor as a floor to be at a lowest level, the information for conversion;

a terminal side storing unit to store the information for conversion which is received by the terminal side communication unit; and a terminal side data conversion unit to convert the operation key information that is the operation key information corresponding to the lowest level floor and the operation key information corresponding to a floor other than the lowest level floor, which is output by the terminal side operation key information output unit into the floor information in accordance with a prescribed conversion rule by using the lowest level designation information included in the information for conversion which is stored in the terminal side storing unit, to generate a destination call registration request which includes the floor information whereto the operation key information is converted and which requests the destination call registration, and to send the destination call registration request which is generated to the elevator control device via the terminal side communication unit.

7. The elevator system as defined in claim 2, wherein the terminal side data conversion unit specifies the operation key information corresponding to the lowest level floor by using the lowest level designation information which is stored in the terminal side storing unit, determines a floor difference between the lowest level floor and each of the floor based on the operation key information corresponding to the lowest level floor and each of the operation key information corresponding to each of the floor, and converts the operation key information which is output by the terminal side operation key information output unit into the floor information based on the floor difference which is determined.

8. The elevator system as defined in claim 3, wherein the terminal side data conversion unit specifies the operation key information corresponding to the lowest level floor by using the lowest level designation information which is stored in the terminal side storing unit, determines a floor difference between the lowest level floor and each of the floor based on the operation key information corresponding to the lowest level floor and each of the operation key information corresponding to each of the floor, and converts the operation key information which is output by the terminal side operation key information output unit into the floor information based on the floor difference which is determined.

9. The elevator system as defined in claim 1, wherein the terminal side data conversion unit generates a correspondence table which indicates a correspondence of the floor information and the operation key information for each floor which is a floor of a building wherein the elevator is installed, and whereon a car of the elevator can stop, by using the lowest level designation information included in the information for conversion which is stored in the terminal side storing unit.

10. The elevator control device as defined in claim 5, wherein the information for conversion which is stored in the control side storing unit consists of the lowest level designation information and designation information of specific floor application to designate application of a specific floor.

11. An elevator system comprising:

a plurality of destination floor reception terminal devices to output, when an operation key corresponding to a floor of a destination floor of an elevator is operated, operation key information corresponding to the operation key, to convert the operation key information which is output into floor information which is used for a registration of a destination call by using information for conversion as prescribed, and to generate and send a destination call registration request which includes the floor information whereto the operation key information is converted, and which requests the registration of the destination call; and an elevator control device to receive the destination call registration request from each of the plurality of destination floor reception terminal devices via a communication channel, and to register the destination call in accordance with the floor information which is included in the destination call registration request, wherein the elevator control device includes a control side storing unit to store the information for conversion, and a control side communication unit to send the information for conversion which is stored in the control side storing unit to the plurality of destination floor reception terminal devices via the communication channel, wherein each of the plurality of destination floor reception terminal devices includes a terminal side communication unit to receive the information for conversion from the elevator control device via the communication channel, a terminal side storing unit to store the information for conversion which is received by the terminal side communication unit, a terminal side operation key information output unit to output the operation key information when the operation key is operated, and a terminal side data conversion unit to convert the operation key information which is output by the terminal side operation key information output unit into the floor information in accordance with a prescribed conversion rule by using the information for conversion which is stored in the terminal side storing unit, to generate the destination call registration request which includes the floor information whereto the operation key information is converted, and to send the destination call registration request which is generated to the elevator control device via the terminal side communication unit, wherein the information for conversion stored in the control side storing unit includes at least lowest level designation information to designate the operation key information corresponding to a lowest level floor as a floor to be at a lowest level, and wherein the terminal side data conversion unit specifies the operation key information corresponding to the lowest level floor by using the lowest level designation information which is stored in the terminal side storing unit, determines a floor difference between the lowest level floor and each of the floor based on the operation key information corresponding to the lowest level floor and each of the operation key information corresponding to each of the floor, and converts the operation key information which is output by the terminal side operation key information output unit into the floor information based on the floor difference which is determined.

12. A destination floor reception terminal device of an elevator to receive a registration of a destination floor of the elevator, the destination floor reception terminal device of the elevator comprising:

a terminal side operation key information output unit to output, when an operation key corresponding to the destination floor is operated, operation key information corresponding to the operation key;

a terminal side communication unit to receive, from an elevator control device to register a destination call for the elevator in response to a request, and to send information for conversion to convert the operation key information into floor information which is used for a destination call registration, the information for conversion;

a terminal side storing unit to store the information for conversion which is received by the terminal side communication unit; and a terminal side data conversion unit to convert the operation key information which is output by the terminal side operation key information output unit into the floor information in accordance with a prescribed conversion rule by using the information for conversion which is stored in the terminal side storing unit, to generate a destination call registration request which includes the floor information whereto the operation key information is converted and which requests the destination call registration, and to send the destination call registration request which is generated to the elevator control device via the terminal side communication unit, wherein the information for conversion which is sent by the elevator control device includes at least lowest level designation information to designate the operation key information corresponding to a lowest level floor as a floor to be at a lowest level, and wherein the terminal side data conversion unit specifies the operation key information corresponding to the lowest level floor by using the lowest level designation information which is stored in the terminal side storing unit, determines a floor difference between the lowest level floor and each of the floor based on the operation key information corresponding to the lowest level floor and each of the operation key information corresponding to each of the floor, and converts the operation key information which is output by the terminal side operation key information output unit into the floor information based on the floor difference which is determined.

* * * * *